United States Patent [19]

Stevens et al.

[11] 4,360,169

[45] Nov. 23, 1982

[54] CABLE TENSIONING AND APPLYING APPARATUS

[75] Inventors: Samuel B. Stevens, Pekin; Richard W. Kizer, Morton, both of Ill.

[73] Assignee: Caterpillar Tractor Co., Peoria, Ill.

[21] Appl. No.: 147,890

[22] Filed: May 8, 1980

Related U.S. Application Data

[63] Continuation-in-part of Ser. No. 91,677, which matured from PCT/US79/00483, filed Jul. 9, 1979, 102(e) date Jul. 9, 1979.

[51] Int. Cl.[3] ..... B65H 81/02; B29H 17/02; H01F 41/08

[52] U.S. Cl. ..... 242/4 BE; 156/397; 242/75.3

[58] Field of Search ..... 242/4 R, 4 B, 4 BE, 242/75.51, 75.53, 75.3, 7.13, 7.22, 7.23, 7.21, 147, 156, 156.3, 156.4; 57/3, 16, 13, 11, 18, 10; 156/397, 425, 428, 117

[56] References Cited

U.S. PATENT DOCUMENTS

| | | | |
|---|---|---|---|
| 1,603,801 | 10/1926 | Potter | 242/4 BE |
| 1,879,882 | 9/1932 | Pullets | 242/4 BE |
| 1,929,087 | 10/1933 | Wood | 242/75.3 |
| 1,994,661 | 3/1935 | Pash | 242/4 B |
| 2,253,740 | 8/1941 | Van Hook | 57/18 |
| 2,267,107 | 12/1942 | Juillard | 242/75.3 |
| 2,875,570 | 3/1959 | Sarracino | 57/13 |
| 3,486,317 | 12/1969 | Grawey et al. | 57/3 |
| 3,606,921 | 9/1971 | Grawey | 156/117 X |
| 3,864,188 | 2/1975 | Grawey et al. | 156/397 |
| 4,042,435 | 8/1977 | Houck . | |
| 4,170,864 | 10/1979 | Beyerl et al. . | |

FOREIGN PATENT DOCUMENTS

| | | | |
|---|---|---|---|
| 2152185 | 7/1973 | Fed. Rep. of Germany . | |
| 2414302 | 11/1975 | Fed. Rep. of Germany . | |
| 2700320 | 7/1977 | Fed. Rep. of Germany . | |
| 2747429 | 4/1978 | Fed. Rep. of Germany . | |
| 2758079 | 7/1979 | Fed. Rep. of Germany . | |
| 569233 | 12/1956 | Italy | 242/7.13 |
| 770661 | 3/1957 | United Kingdom | 242/4 BE |

*Primary Examiner*—Billy S. Taylor

*Attorney, Agent, or Firm*—Wegner, Stellman, McCord, Wood & Dalton

[57] ABSTRACT

An apparatus (16) is provided for winding inextensible flexible elongate material, such as cable (15), on a carcass (10) of a body while maintaining the tension on the elongate material (15) substantially uniform. A shuttle (20) carries at least one compensator arm assembly (30,130) resiliently supporting a housing (44,144) having a sheave (50,150) in line with an energy-dissipator (80,180) on the side of the sheave (50,150) closest to the carcass so that the elongate material (15) being fed from a spool (28) under tension and passing over the sheave (50,150) as the shuttle (20) is rotating around the torus-shaped body will apply the elongate material to the carcass (10) under substantially uniform tension as the arm assembly (30,130) stores up elongate material (15) during periods of low material demand and pays out elongate material during periods of high material demand.

3 Claims, 5 Drawing Figures

FIG. 1.
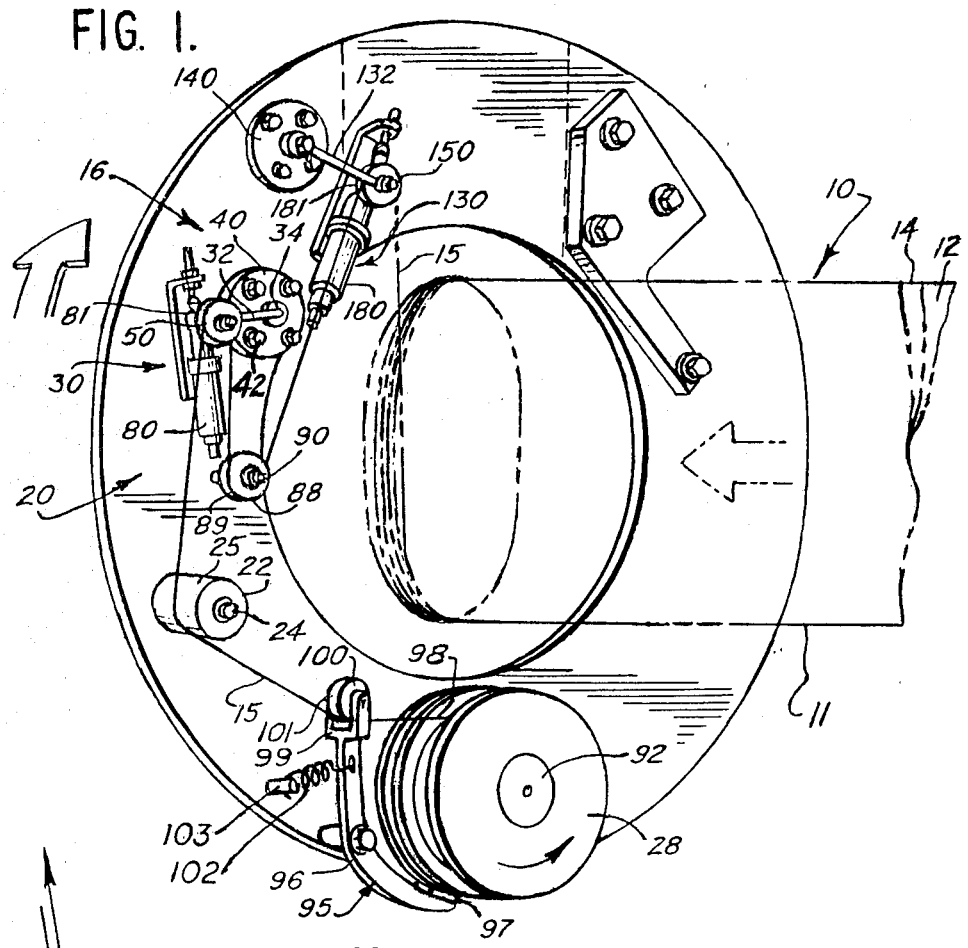
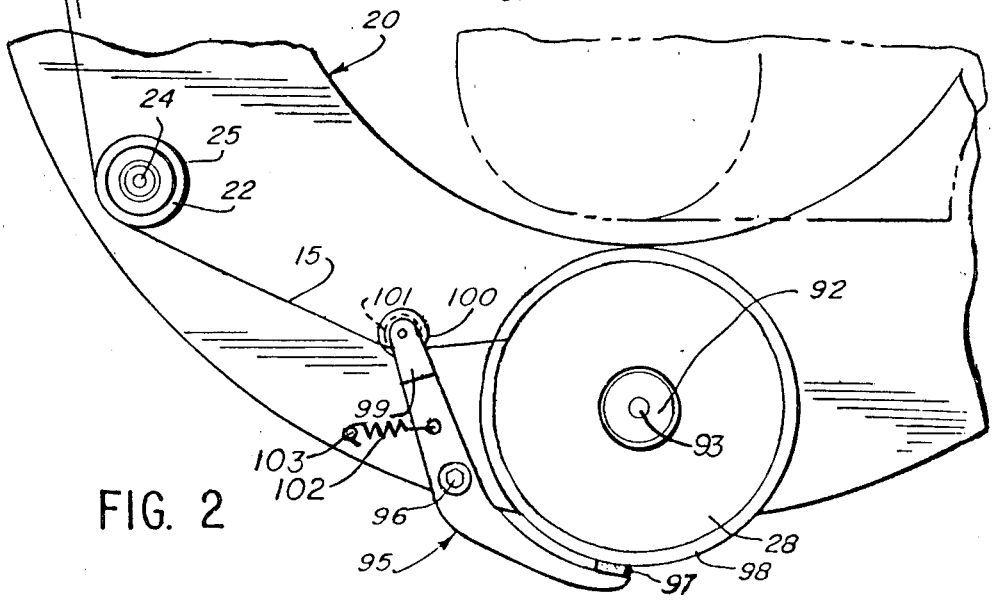
FIG. 2

FIG. 4
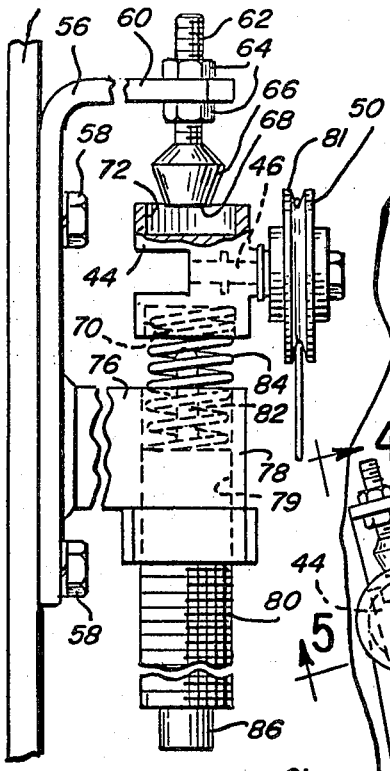
FIG. 3
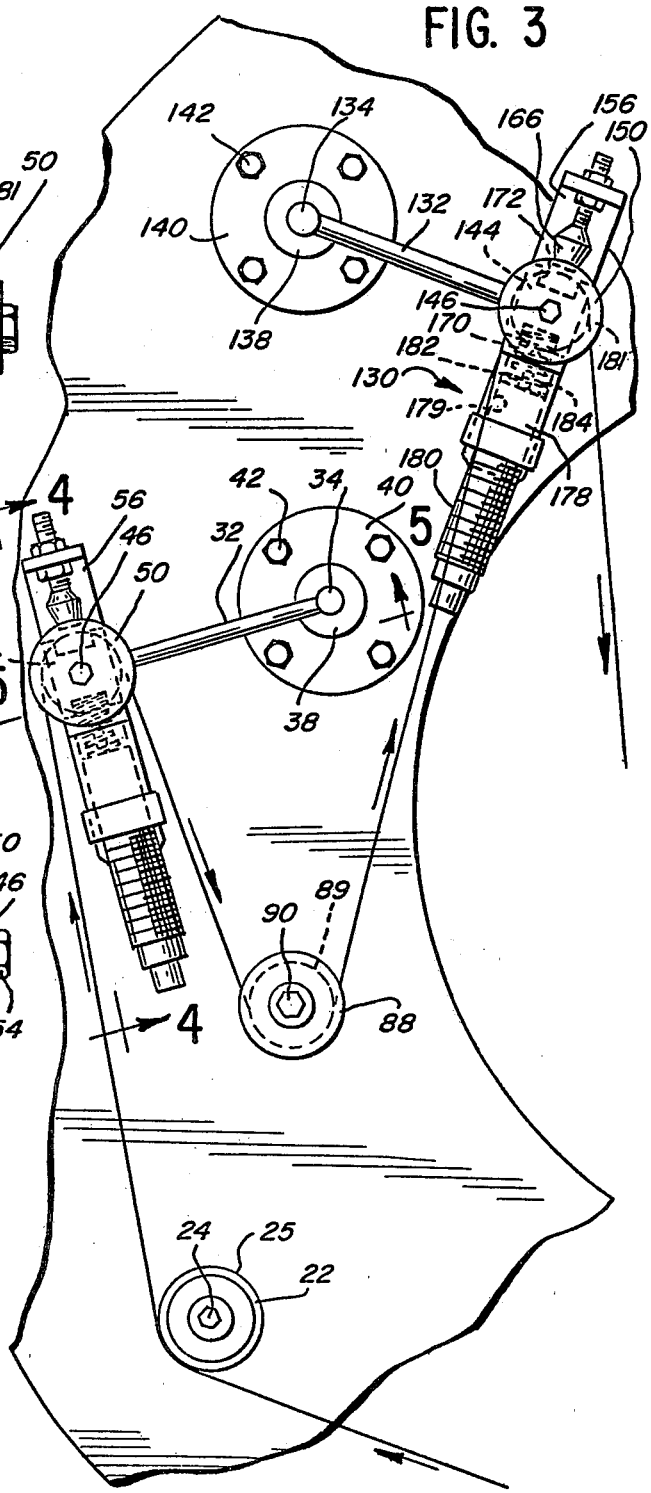
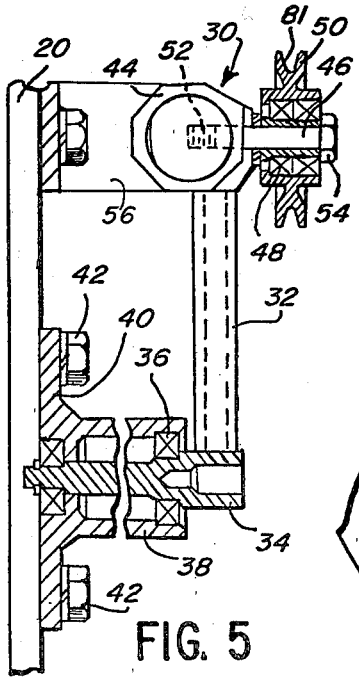
FIG. 5

CABLE TENSIONING AND APPLYING APPARATUS

DESCRIPTION

CROSS-REFERENCE TO RELATED APPLICATION

This application is a continuation-in-part of application Ser. No. 91,677, filed July 9, 1979, now abandoned.

TECHNICAL FIELD

This invention relates to wrapping apparatus and, more particularly, to apparatus for wrapping flexible material on a toroidal body.

BACKGROUND ART

In wrapping an inextensible flexible cable on the carcass of a torus-shaped tire, it is important that the cable be fed to the carcass under a uniform tension and, since the tire is not circular in transverse section, it is necessary to provide a system that will guide the cable onto the carcass in the desired configuration.

Apparatus is available for wrapping a flexible cable on a torus-shaped carcass which necessitates rotating the carcass in one direction as an applicator head moves in a direction substantially transverse thereto in contact with the carcass to lay the cable on the surface thereof in a continuous helical pattern. A cam, shaped to coincide with the shape of the cross section of the carcass, is provided to coact with a brake assembly for maintaining substantially constant tension on the cable supplied to the applicator head as the applicator head traverses the toroidal shape of the carcass. Mechanical apparatus, such as air cylinders, are provided to move the applicator head into contact with the carcass. Although this prior apparatus has been successful, and has satisfied the cable wrapping requirements, it is necessary to change the cam with each different sized carcass. In addition, the applicator head, being in contact with the carcass, received wear that required repair or replacement. The system required that air pressure had to be maintained to move the head into contact with the carcass.

DISCLOSURE OF INVENTION

The present invention is directed to overcoming one or more of the problems as set forth above.

According to the present invention, an improved apparatus is provided for winding inextensible flexible elongate material, such as cable, on the carcass of a body having a torus shape in cross section wherein the carcass may be positioned on one side wall with a principal axis extending vertically with respect to the plane of the side wall. As the torus-shaped body is rotated about said vertical axis, a shuttle is rotatably driven about the body in a plane perpendicular to the plane of the side wall. Carried by the shuttle is a supply of elongate material, such as cable, which is let-off from the supply under a predetermined tension. At least one compensator arm assembly on the shuttle resiliently supports a sheave over which the elongate material or cable passes as it traverses from the supply to the carcass for application to the carcass in a helical pattern.

The resilient support for the sheave is provided by a resilient member mounted on the shuttle away from the carcass side of the sheave which, when combined with the compensator arm assembly, adjusts for the demand for the elongate material as the elongate material is applied to the toroidal-shaped carcass under a uniform tension. An energy-dissipating member is provided on the shuttle on the carcass side of the compensator arm to cushion excessive loads in that direction while a resilient stop is provided in the path of travel of the compensator arm outboard of the carcass to cushion excessive sudden reductions in elongate material demands, such as when the material breaks, or the like. The elongate material is guided onto the surface of the carcass by one sheave carried by the rotating shuttle without the sheave contacting the carcass.

The elongate material is applied in a uniform helical pattern which may be in as spaced, or in as tight, a side-to-side configuration as is desired.

BRIEF DESCRIPTION OF DRAWINGS

FIG. 1 is a perspective view of a shuttle encircling a horizontally disposed toroidal carcass to apply a continuous helix of inextensible elongate material, in this case cable, under constant tension thereto;

FIG. 2 is an enlarged, broken away view of the supply spool of cable and a brake arrangement so that cable is withdrawn from the spool under substantially uniform tension;

FIG. 3 is an enlarged, elevational view of a portion of the shuttle showing the cable tensioning and applicator apparatus forming the subject matter of this invention;

FIG. 4 is a view taken along the line 4—4 of FIG. 3; and

FIG. 5 is a view, partially in section, taken along the line 5—5 of FIG. 3.

BEST MODE FOR CARRYING OUT THE INVENTION

Referring to FIG. 1, a toroidal member 10, such as the carcass of a torus tube body, is shown in phantom in horizontal position lying on a side wall 11 and being driven about the vertical axis of the toroidal member. It is to be understood that the toroidal member 10 could be in a vertical position with the axis of rotation being about the horizontal axis of the member. The toroidal member 10 could be the carcass of a torus tire of the type shown and described in U.S. Pat. No. 3,606,921 issued Sept. 21, 1971 to Charles E. Grawey and assigned to the common assignee of the present application. The toroidal member 10, as shown, is comprised of a disintegrable core 12 over which one or more layers of rubber have been laid to form a tube 14. In the process of manufacturing a torus tire of the Grawey U.S. Pat. No. 3,606,921 type, a continuous helix of inextensible cable 15 is wrapped around the tube 14, which cable 15 should have a substantially uniform tension and be spaced from adjacent passes of the cable by a uniform amount. To accomplish the winding of the cable 15 on the toroidal member 10 under uniform tension and with uniform spacing, a shuttle member 20, including an improved tension compensating apparatus 16 is provided.

As illustrated, the cable tension compensating apparatus 16 is mounted on one side of a shuttle frame member 20. It is to be understood that the tension compensating apparatus 16 could be mounted on a separate plate which in turn is attached to the shuttle 20 without departing from the spirit of the invention. The shuttle frame member 20 is mounted on a frame and has a shuttle drive mechanism, not shown, which propels the shuttle in a circular path around the body of the toroidal member 10 in a plane generally perpendicular to the plane containing the side wall of the member 10.

As shown, particularly in FIGS. 1 and 3, the cable tension compensating apparatus 16 comprises a sleeve roller 22 rotatably mounted on a shaft 24 extending transverse to the plane of the shuttle. A surface 25 on the sleeve roller 22 is axially relatively extensive to permit a cable drawn around the curve of the surface 25 to traverse from a location close to the shuttle 20 to a location close to the outer extremity of the roller as the cable is drawn from a supply spool 28.

A compensator arm assembly 30 is mounted on the shuttle frame in spaced relation to the roller 22 and comprises an arm member 32 mounted at one end on a pivot shaft 34, see FIG. 5, which shaft 34 extends through a pair of spaced apart bearings 36 in a hub 38 outwardly extending from a flange 40 bolted by bolts 42 to the shuttle surface, the arm 32 being free to rotate about the axis of the pivot shaft 34. At the outboard end of the arm 32 is fastened a housing 44 which has a pivot shaft 46 transversely extending outwardly, away from the shuttle surface. A sheave 50 is rotatably supported on the shaft 46 about bearings 48 on the shaft. The pivot shaft 46 has threads at 52 on one end and has a head 54 on the other end so that the shaft can be inserted through the bearings 48 and sheave 50 and threaded into the housing 44.

As shown in FIG. 4, a bracket 56 is bolted at 58 to the shuttle surface and has at one end an outwardly extending portion 60 through which a threaded rod 62 passes and which rod is adjustably locked in position by a pair of lock nuts 64 on opposite sides of portion 60. On the depending end of the threaded member 62 is mounted a resilient bumper 66 which has a face portion 68 facing in the direction of the housing 44. The housing 44 has two oppositely facing recesses 70 and 72 facing in directions transverse to the longitudinal axis of the arm 32. The resilient bumper 66 aligns with the recess 72 on the upwardly facing portion of housing 44. The bracket 56 has an outwardly extending plate 76 with a portion 78 defining an opening 79 in the extended end thereof with the axis of the opening 79 aligning with the housing 44 and with the resilient bumper 66 carried by the portion 60 of the bracket 56. An energy-dissipating member 80, such as a shock absorber, is secured in the opening 79 and has a probe 82 aligning with the resilient bumper 66 and with the recess 70 on the housing 44. A compression spring 84 encircles the probe 82 and has one end nesting in the recess 70 of the housing 44 and has the other end nesting in the opening 79 and against the end wall of the energy-dissipating member 80. The spring 84 urges the outer end of the arm 32, the housing 44 and the attached sheave 50 in a direction generally away from the sleeve roller 22. The cable 15 extends from the sleeve roller 22 into the groove 81 of the sheave 50 and around the upper extent of the sheave 50. The axis of the arm 32 should approach a radius of the shuttle 20 so as to minimize centrifugal forces on the compensator arm assembly 30.

The energy-dissipating member 80 is a shock absorber of the type generally available on the market. One such device is sold by Enidine of Buffalo, New York and is identified in their Bulletin No. 1183-1-77 as an OEM shock. The energy-dissipating member 80 has a projecting knob 86 which can be turned to adjust the energy absorbing characteristics of the member 80.

An idler sheave 88 having a groove 89 in the outer periphery thereof, is rotatably mounted on a shaft 90 secured to the shuttle surface at a location generally between the sleeve roller 22 and the compensator assembly 30. The cable 15 will extend from the roller 22 into the groove 81 of the sheave 50 and in the groove 89 of the idler sheave 88 with the length of cable from the roller 22 to the sheave 50 approaching parallelism with the length of cable from the sheave 50 to the sheave 88. The groove 81 of sheave 50 is in the same plane as the groove 89 of sheave 88.

A second compensator arm assembly 130 is mounted on the shuttle surface in circumferentially spaced relation from the idler pulley 88 and from the first compensator arm assembly 30. The compensator arm assembly 130 is designed and constructed the same as compensator arm assembly 30 and, therefore, a detailed discussion of the structure of the compensator arm assembly 130 will not be repeated. The compensator arm assembly 130 has an arm 132 pivotally mounted on a shaft 134 carried by a hub 138 projecting from a flange 140 and bolted by bolts 142 to the shuttle surface. The extended end of the arm 132 has a housing 144 which supports a pivot shaft 146 for a sheave 150. The housing 144 has oppositely facing recesses 170 and 172 with a bumper 166 carried by a bracket 156 aligned with the recess 172 and a spring 184 seated in the recess 170 and in an opening 179 in a portion 178 carried by the bracket 156. An energy-dissipating member 180 is, likewise, carried by the portion 178 with a probe 182 aligned with the housing 144. The groove 181 in the sheave 150 is in the same plane as the groove 89 in sheave 88 and the groove 81 of sheave 50. The cable 15 extends from the groove 89 of the idler sheave 88 around the portions of the groove 181 remote from the sheave 88 and on toward the carcass of the toroidal member 10. The second arm assembly 130 is located in alignment with idler sheave 88 such that the length of cable 5 from idler sheave 88 to sheave 150 is as close to parallel to the length of cable 15 extending from the sheave 150 to the carcass as is feasible. The axis of the arm 132 should approach a radius of the shuttle 20 so as to minimize the centrifugal effect on the compensator arm assembly 130.

The shuttle member 20 has a transversely extending hub 92 rotatably mounted on a fixed shaft 93 fastened to the shuttle in spaced relationship to the sleeve pulley 22 and is adapted to receive the removable spool 28 upon which is wound a supply of inextensible flexible elongate material, such as cable 15. A brake member 95 is pivotally mounted on pivot 96 extending from the shuttle frame 20. The brake member 95 has a brake pad 97 mounted on one end portion and bearing against a brake drum 98 mounted on the hub 92. The brake drum 98, hub 92 and supply spool 28 rotate together as a unit about the shaft 93 and relative to the shuttle 20. The end of the brake member 95 spaced from the brake pad 97 has a bifurcated portion 99 for supporting a rotatable sheave 100 having a groove 101 in which the cable 15 rides as it is drawn from the spool 28. A tension spring 102 has one end anchored by a pin 103 carried by the shuttle 20 and has the other end engaging the brake member 95 between the pivot 96 and the bifurcated portion 99 so as to urge the brake pad 97 against the brake drum 98 with a predetermined force.

The groove 101 of the sheave 100 is located in the path of the cable 15 such that the direction of the cable 15 is changed as it leaves the spool 28, passes around sheave 100 and extends on to the sleeve pulley 22. The cable 15 engaging the sheave 100 will pivot the brake 95 against the spring force to lessen or to release the urging of brake pad 97 against the brake drum 98 thereby reducing the resistance to rotation of the spool 28.

To pull the cable 15 from the spool 28 past the brake 95 and on toward the tensioning and applying apparatus 16 will require the cable to be under a tension sufficient to overcome the force of the brake 95. The brake 95 will apply a force to the drum 98 and spool 28 so that cable 15 leaving the spool 28 is under a tension dictated by the drag of the brake 95 on the drum 98. If the tension in the cable 15 slackens, the spring 102 will pivot the brake 95 and urge the pad 97 against the drum 98 to increase the drag on the drum 98 which will increase the resistance to removing cable from the drum. As the resistance to removing cable from the drum increases, the tension in the cable will increase which will pivot the brake 95 against the force of spring 102 to, once again, reduce the braking drag on the spool 28. An appropriate equilibrium condition will result affording the proper tension to the cable. Any appropriate brake 95 is acceptable for applying resistance to the spool 28 and tension to the cable 15 as the cable is drawn from the spool 28.

The cable 15, as it is drawn from the spool 28, passes under the sheave 100 of brake 95, contacts the sleeve roller 22, is wrapped partially around the sheave 50, doubles back upon itself to partially encircle the idler sheave 88 and, once again, doubles back upon itself to partially encircle the sheave 150 from which the cable extends to the exterior surface of the toroidal member 10.

Industrial Applicability

The shuttle 20 is mounted for rotation in a plane substantially perpendicular to the plane of the side upon which the toroidal member or carcass 10 lies. A drive mechanism, not shown, is provided for rotating the shuttle 20 about the vertical axis of a transverse body section of the toroidal member 10 as the toroidal member is rotated in the plane containing the side of the carcass. Initially, the cable 15 is held against the outer surface of the carcass by a tacking strip or tacking member whereupon the shuttle is turned slowly for one or two revolutions so as to securely tack the end of the cable 15 to the carcass. The shuttle is then driven at relatively high speeds about the toroidal portion of the carcass as the carcass is slowly rotated about the vertical axis of the carcass so that the cable 15 is laid up in a helix around the oval or toroid of the carcass as it is drawn from the sheave 150.

The cable 15 is drawn from the spool 28 under substantially uniform tension and, as it traverses the compensator arm assembly 30 and the compensator arm assembly 130, the springs 84 and 184 are loaded so as to retain uniform tension on the cable 15 as it is applied to the carcass. Due to the toroidal cross-sectional shape of the carcass 10, the cable will be applied at varying distances from the sheave 150. This will cause the cable to be applied at a slightly more rapid rate around the side walls of the tire and at slightly slower rates along the flat walls of the tire. The compensator arm assemblies 30,130 will provide the added material or will compensate for the need for less material by adjusting toward or away from the toroidal member 10. That is, during periods of high demand as more cable is needed in order to maintain the constant tension on the cable, the compensator arm 132 will pivot in a clockwise direction compressing the spring 184 and the compensator arm 32 will pivot in a counterclockwise direction compressing spring 84, both of which movements of the compensator arms 132,32 are toward the carcass to satisfy the high demand. During periods of lower or low demand, the spring 184 will pivot the compensator arm 132 in a counterclockwise direction and the spring 84 will pivot the arm 32 in a clockwise direction to elongate the path of the cable through the cable tensioning compensating apparatus 16 while maintaining the cable under a substantially uniform tension. Pivoting of the compensator arms 132 and/or 32 will pay out the additional material needed during those periods when more cable is needed. Upon the cable demand returning to normal or returning to a less demanding traverse of the toroidal member 10, the springs 184,84 will move the sheaves 150 and 50 away from the idler roller 88 and sleeve roller 22 to store up material while retaining a substantially uniform tension on the material.

In the event the slackening is sudden, the housings 44,144 will approach or bump against the bumper members 166 and 66. Sometimes the shift from high demand to low demand brought about by the relative sharp change in carcass profile, will be rather sudden, at which time, the housings 144 and 44 will move rapidly toward the bumpers 166 and 66 and will strike the bumpers to dissipate the excess energy. Likewise, the demands for additional cable sometimes will occur suddenly and will cause the sheaves 50,150 to move rapidly toward the sleeve roller 22 and idler roller 88, striking the probes 82 and 182 of the shock absorbers 80 and 180 to dissipate the surplus energy in the shock absorber. The apparatus will operate with only one of the two compensator arm assemblies 30,130 operating, that is, with arm assembly 130 inoperative, the sheave 150 acts as the guide to guide the material onto the carcass while arm assembly 30 functions to maintain the substantially uniform tension on the elongate material during periods of high and low demand. Similarly, with the arm assembly 30 inoperative, the arm assembly 130 functions both as a guide for guiding the material onto the carcass and for maintaining the substantially uniform tension on the elongate material during periods of high and low demand. The chief difference between both arm assemblies 30,130 functioning and only one arm assembly functioning, is in the range of accommodation for high and low demand, the range being substantially increased with both arm assemblies being operative.

The cable tension compensating apparatus is such that it does not require a cam guide to apply cable 15 to a carcass 10. The construction of the cable tension compensating apparatus permits its use on different diametered and different toroidal sized carcasses without the need for replacing cams or without the need for different applicator heads. The improved cable tension compensating apparatus 16 is operative without the need for an applicator head and is operative independently of the tensioning of the cable drawn from the supply spool. The sheave 150 serves as a spaced applicator head in that it guides the cable onto the surface of the carcass, but it does so without contacting the carcass as the cable is laid on the carcass. In this way, the adjacent stretches of cable on the carcass can be relatively closely positioned at the inboard side of the carcass since there is no guide on the applicator head bearing against the carcass that previously spaced the adjacent stretches of the cable sometimes an excessive amount.

We claim:

1. In an apparatus (16) for winding flexible elongate material (15) on a member (10) having a non-cylindrical cross-sectional shape which causes variations in the demand for elongate material being applied thereto, the apparatus including a shuttle (20), a supply (28) of elongate material (15) carried by the shuttle (20) and having tensioning means (95) for applying tension to the elongate material (15) drawn from the supply (28), the improvement comprising:

means (30,130) for storing and paying out elongate material (15) in response to the variations in the demand for elongate material, said means (30,130) being independent of said tensioning means (95) and including an arm (32,132) pivotally mounted at one end portion of said shuttle and extending from said pivot mounting toward a mid portion of the shuttle, a housing (44,144) supported on a free end portion of said arm (32,132), sheave means (50,150) rotatably supported on the housing (44,144) at a location spaced from said pivot mounting, said arm having its longitudinal axis extending from said pivot mounting toward said mid-portion of the shuttle and approaching a radius of the shuttle to minimize centrifugal forces acting on said sheave means (50,150) as the shuttle is rotated, an energy-dissipating member (80,180) carried by said shuttle (20), a probe (82,182) on said energy-dissipating member (80,180) projecting toward said housing (44,144) on the side of said housing facing said supply of elongate material, resilient means (84,184) for urging said arm (32,132) and sheave means (50,150) about said pivot mounting away from said supply of elongate material for storing elongate material, said resilient means (84,184) being carried on said energy-dissipating member (80,180) and bearing on said housing (44,144), said resilient means (84,184) being compressed by an increase in the tension of said elongate material thereby moving said housing against said resilient means and selectively contacting the probe (82,182) of the energy-dissipating member (80,180), and a bumper (66,166) carried by said shuttle (20) in alignment with said housing (44,144) on the opposite side of the housing (44,144) from said resilient means (84,184), said housing (44,144) being moved by said resilient means (84,184) away from said supply of elongate material and against said bumper (66,166) upon sudden release of the tension on the elongate material (15), said resilient means (84,184) maintaining said elongate material under uniform tension as said elongate material (15) is pulled from said supply (28) about said sheave means (50,150) and is applied to said member (10) as the shuttle (20) is rotated about said member (10).

2. An apparatus (16) as claimed in claim 1 including a second arm (132) pivotally mounted on said shuttle (20) and has sheave means (150) carried on said second arm (132) at a location spaced from said pivot mounting, resilient means (184) on said shuttle (20) urging said second arm (132) and sheave means (150) about said pivot mounting and away from said supply of elongate material, one of said sheave means (50) receiving said elongate material from said idler roller (22) before it is directed on to the other sheave means (150) carried by said second arm (132).

3. An apparatus (16) as claimed in claim 2 including an idler sheave (88) carried by said shuttle (20) between said one arm (32) and said second arm (132) for receiving said elongate material (15) from said one sheave means (50) on said one arm (32) and directing it onto the sheave means (150) on said second arm (132).

* * * * *